US006898396B2

(12) United States Patent
Furuki et al.

(10) Patent No.: US 6,898,396 B2
(45) Date of Patent: May 24, 2005

(54) IMAGE FORMING APPARATUS AND A PROCESS CARTRIDGE WHICH IS ATTACHABLE AND DETACHABLE FROM THE IMAGE FORMING APPARATUS

(75) Inventors: Manabu Furuki, Minamiashigara (JP); Koji Fukushima, Minamiashigara (JP); Yoshihiro Maekawa, Minamiashigara (JP); Naoki Ohnishi, Minamiashigara (JP); Jin Kasono, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/616,992

(22) Filed: Jul. 11, 2003

(65) Prior Publication Data

US 2004/0126138 A1 Jul. 1, 2004

(30) Foreign Application Priority Data

Dec. 12, 2002 (JP) ..... 2002-360834

(51) Int. Cl.[7] ..... G03G 15/30; G03G 15/02; G03G 15/08

(52) U.S. Cl. ..... 399/149; 399/174; 399/252

(58) Field of Search ..... 399/98, 129, 149, 399/150, 174, 175, 176, 252, 343

(56) References Cited

U.S. PATENT DOCUMENTS

| | | | | | |
|---|---|---|---|---|---|
| 5,241,342 | A | * | 8/1993 | Asano et al. | 399/175 |
| 5,915,150 | A | * | 6/1999 | Kukimoto et al. | 399/149 |
| 5,970,285 | A | * | 10/1999 | Ito et al. | 399/149 |
| 6,215,967 | B1 | * | 4/2001 | Takeda et al. | 399/149 X |
| 6,449,448 | B2 | * | 9/2002 | Bessho et al. | 399/149 |
| 6,560,426 | B2 | * | 5/2003 | Sakaizawa et al. | 399/150 |
| 6,600,887 | B2 | * | 7/2003 | Takami et al. | 399/174 |

* cited by examiner

*Primary Examiner*—Sandra L. Brase
(74) *Attorney, Agent, or Firm*—Oliff & Berridge, PLC

(57) ABSTRACT

An image forming apparatus containing an image holding member, a contact-type charger for charging a surface of the image holding member, an exposure unit for forming an electrostatic latent image by exposing the charged surface of the image holding member, a developing unit for developing the electrostatic latent image with a spherical toner to obtain a toner image, and a transfer member for electrostatically transferring the toner image from the surface of the image holding member onto a transfer material. A number of toner particles remaining on the surface of the image holding member before passing through an abutting portion between the image holding member and the contact-type charger is in a range of 100 to 400 per unit area ($mm^2$).

16 Claims, 1 Drawing Sheet

IMAGE FORMING APPARATUS AND A PROCESS CARTRIDGE WHICH IS ATTACHABLE AND DETACHABLE FROM THE IMAGE FORMING APPARATUS

CROSS-REFERENCE TO RELATED APPLICATION

This application claims priority under 35USC 119 from Japanese Patent Application No. 2002-360834, the disclosure of which is incorporated by reference herein.

BACKGROUND OF THE INVENTION

1. Field of the Invention

The present invention relates to an image forming apparatus utilizing an electrophotographic method, such as a compact copying machine, a printer, a composite machine and the like, more particularly, an image forming apparatus which is improved for solving the inconvenience when using a substantially spherical toner. The present invention also relates to a process cartridge which is attachable to and detachable from the image forming apparatus.

2. Description of the Related Art

In an image forming apparatus utilizing an electrophotographic method, image forming is performed by forming an electrostatic latent image on the surface of an image holding member composed of an organic photosensitive material or the like in the form of a drum or a belt by the known electrophotographic process, developing the electrostatic latent image into a toner image using a toner, electrostatically transferring this toner image onto a recording paper directly or via an intermediate transfer material, and coalescing the toner on the surface of the recording paper by heating or the like.

As such a toner, there is mainly used a dry toner obtained by dispersing a colorant, a charge control agent and the like, if necessary, in a resin as a main component, and forming the dispersion into a particle shape. Such a dry toner, regardless of it is to be used in a one-component developer or a two-component developer, is prepared, in most cases, by a so-called mechanical grinding method of kneading and uniformly dispersing a colorant and the like in a resin as a main component, mechanically grinding the dispersion, and classifying the ground material so as to obtain a desired particle diameter and particle size distribution.

Meanwhile, in such an image forming apparatus, due to recent demands for high image quality, it has been required that a particle size of the toner be smaller, and a particle size distribution of such a toner be narrower. When the particle size distribution is wide, a ratio of toner particles having a relatively smaller particle size and toner particles having a relatively larger particle size increases, and this increase may lead to the following inconveniences. When there are many toners having a small particle size, these toners become easy to fly from a developing unit, resulting in pollution of an image forming apparatus. Moreover, in the case of a two-component developer, since the small size toner becomes easy to adhere to a carrier, the chargeability of a toner is reduced. On the other hand, when there are many toners having a large particle diameter, there arises the inconvenience such as reduction in the image quality.

However, when one produces such a toner of a small particle size having a narrow particle size distribution by the aforementioned mechanical grinding method, the productivity and the yield become considerably worse, resulting in a cost increase. For this reason, a wet process such as a polymerization method, a dissolution method, or the like is proposed as a process for preparing such a toner.

The polymerization method is to obtain toner particles by granulation through a polymerization reaction in the state where a colorant, etc. is mixed with a monomer material. Since a particle size can be controlled by adjusting reaction time or the like, a particle size distribution can be very narrow in principle.

The dissolution method is to obtain toner particles by preparing an oily phase by dissolving or dispersing a binding resin, a colorant and the like in an organic solvent, and suspension-granulating the oily phase components in an aqueous phase, and this process can make a particle diameter small and control a particle size distribution.

A toner obtained by a wet process such as a polymerization method or a dissolution method has the characteristics that a particle shape is substantially spherical, while a toner particle obtained by the aforementioned mechanical grinding method generally does not have a specific shape. For this reason, since a substantially spherical toner obtained by a wet process has a smaller particle diameter and a spherical shape as compared with a toner obtained by the mechanical grinding method, a contact area between the toner and the surface of an image holding member is small and, therefore, the toner is known to have merits that a force of adhering the toner to the surface of an image holding member becomes small, and the transferring efficiency is considerably improved. Since such a better transferring efficiency reduces the number of toners which are discarded without being utilized for forming an image, an amount of a toner to be used can be reduced, and thus such a toner is economical, and environmentally friendly as compared with a conventional toner.

SUMMARY OF THE INVENITION

It is known that since a toner produced by the aforementioned wet process has a substantially spherical particle shape, and has the following demerits. When the number of toner particles (a total number of toner particles remaining on the surface of an image holding member after transference, the number of fog toner particles and the number of cloud toner particles) remaining on the surface on an image holding member is large in an image forming apparatus, in particular, in a cleanerless image forming apparatus, the toner particles adhere to the surface of a contact-type charger when the toner passes through an abutting portion between the contact-type charger and the image holding member. Thereupon, repetition of such adhesion causes pollution of the surface of the contact-type charger, whereby a well charged state cannot be maintained. Thus, when an image is formed under the conditions that the contact-type charger is polluted, white spots occur in the resulting image, leading to deterioration in the image quality. In addition, when the number of toner particles remaining on the surface of an image holding member is small, remaining toner particles tend to be subjected to a greater pressure at an abutting portion between a contact-type charger and an image holding member, or between a transfer member and an image holding member. When passing therethrough, the remaining toners are deformed and adhere to the surface of an image holding member. By repetition of such an adhesion, toner filming occurs in which a toner adheres as a foreign matter to the surface of an image holding member. When image formation is performed in a state where this toner filming occurs, a remaining image and a streak occur in the resulting image, resulting in deterioration in the image quality.

The present invention is to solve the problems in the prior art, and to attain the following objects. An object of the invention is to provide an image forming apparatus which can perform stable image formation by using a spherical toner, preventing toner pollution of the surface of a contact-type charging means to maintain the well charged state over a long time, and preventing toner filming on the surface of an image holding member. Another object of the present invention is to provide a process cartridge which is attachable to and detachable from the image forming apparatus.

The aforementioned problems can be solved by the following means.

A first aspect of the invention provides an image forming apparatus comprising an image holding member, a contact-type charger for charging a surface of the image holding member, an exposure unit for forming an electrostatic latent image by exposing the charged surface of the image holding member, a developing unit for developing the electrostatic latent image with a spherical toner to obtain a toner image, and a transferring member for electrostatically transferring the toner image from the surface of the image holding member onto a transfer material. Here, a number of toner particles remaining on the surface of the image holding member before passing through an abutting portion between the image holding member and the contact-type charger is in a range of 100 to 400 per unit area ($mm^2$).

A second aspect of the invention provides the image forming apparatus of the first aspect, wherein a toner shape change rate (Tt) of toner particles remaining on the surface of the image holding member before passing through an abutting portion between the image holding member and the contact-type charger is in a range of 50% to 100%, the toner shape change rate (Tt) being represented by the following equation (1):

$$Tt(\%)=(h/x)\times 100 \qquad \text{Equation (1)}$$

[In the equation (1), x represents a maximum length ($\mu$m) of a toner particle projected image, h represents a maximum length ($\mu$m) of a remaining toner particle projected image formed on a plane perpendicular to an axis of the toner particle projected image in a direction of the maximum length thereof, and $x \geqq h$]

A third aspect of the invention provides the image forming apparatus of the first or second aspect, wherein a shape factor (SF) of the spherical toner is 135 or less, the shape factor (SF) being represented by the following equation (2):

$$SF=(2\pi L^2/4A)\times 100 \qquad \text{Equation (2)}$$

[In the equation (2), L represents a maximum length ($\mu$m) of a spherical toner particle projected image, and A represents an area ($\mu m^2$) of the spherical toner particle projected image.]

A fourth aspect of the invention provides the image forming apparatus of any one of the first to third aspects, wherein a volume average particle diameter of the spherical toner is in a range of 2 $\mu$m to 9 $\mu$m.

A fifth aspect of the invention provides a process cartridge comprising at least an image holding member and a contact-type charger for charging a surface of the image holding member, wherein a number of toner particles remaining on the surface of the image holding member before passing through an abutting portion between the image holding member and the contact-type charger is in a range of 100 to 400 per unit area ($mm^2$).

A sixth aspect of the invention provides the process cartridge of the fifth aspect, wherein a toner shape changing rate (Tt) of toner particles remaining on the image holding member before passing through an abutting portion between the image holding member and the contact-type charger is in a range of 50% to 100%, the toner shape changing rate (Tt) being represented by the following equation (1):

$$Tt(\%)=(h/x)\times 100 \qquad \text{Equation (1)}$$

[In the equation (1), x represents a maximum length ($\mu$m) of a toner particle projected image, h represents a maximum length ($\mu$m) of a remaining toner particle projected image formed on a plane perpendicular to an axis of the toner particle projected image in a direction of the maximum length thereof, and $x \geqq h$.]

DETAILED DESCRIPTION OF THE INVENTION

Figure 1:
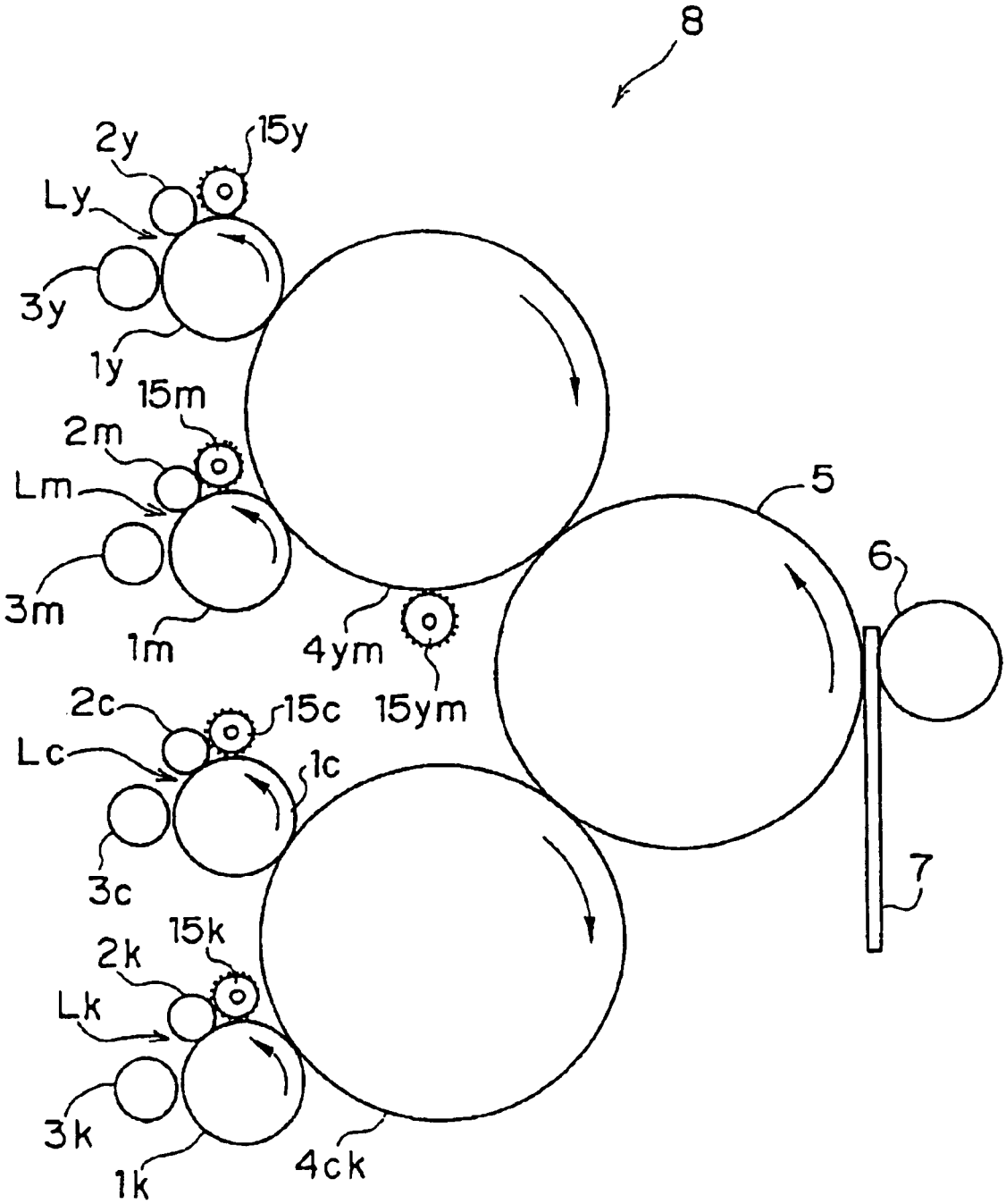
FIG. 1 is a schematic view showing one example of the image forming apparatus of the present invention.

The present invention will be explained in detail below.

The image forming apparatus of the invention is characterized in that a number of toner particles remaining on an image holding member before passing through an abutting portion between the image holding member and a contact-type charging means is in a range of 100 to 400 per unit area ($mm^2$). This number of remaining toner particles is preferably in a range of 150 to 350, more preferably in a range of 200 to 300 per unit area ($mm^2$).

The image forming apparatus of the invention can prevent toner pollution of the surface of a contact-type charging means to maintain a well charged state for a long time. The image forming apparatus can also prevent toner filming on the surface of an image holding member so as to perform stable image formation, by controlling the number of remaining toner particles in the aforementioned range. In addition, by using a spherical toner, generation of waste toner is reduced, and the image forming apparatus is environmentally friendly.

If the number of the remaining toner particles exceeds the aforementioned range, remaining toner particles become too many, and toner particles adhere to the surface of a contact-type charger when passing through an abutting portion between the contact-type charger and the image holding member. Repetition of such adhesion causes pollution of the surface of the contact-type charger, whereby a well charged state cannot be maintained. When an image is formed under the conditions that the contact-type charger is polluted, white spots occur in the resulting image, leading to deterioration in the image quality.

On the other hand, when the number of toner particles remaining on the surface of the image holding member is below the aforementioned range, toners tend to be subjected to a greater pressure at an abutting portion between the contact-type charger and the image holding member, or between the transfer member and the image holding member. When passing therethrough, an amount of deformation of this remaining toner increases (specifically, for example, an amount of a change of a remaining toner (Tt) described later easily becomes to be less than 50%). Since the deformation amount is large, toners adhere to the surface of the image holding member. By repetition of such an adhesion, toner filming occurs in which a toner as a foreign matter adheres to the surface of the image holding member. When image formation is performed in a state where this toner filming is caused, a remaining image and a streak are caused in the resulting image, resulting in deterioration in image quality.

Here, the "remaining toner particle" includes a toner remaining on the surface of an image holding member after transference, a fog toner developed at formation of a non-image portion and remaining, a toner clouded from a developing unit and remaining, a toner not recovered to a developing unit, and the like. A number of remaining toner particles denotes a total number of these toners per unit area ($mm^2$).

The number of remaining toner particles per unit area ($mm^2$) of an image holding member is obtained by measuring arbitrary 10 or more places using a laser microscope (VK8500: manufactured by KEYENCE Corporation) and calculating an average of the number of particles.

The ways for controlling the number of remaining toner particles include various elements such as a developer using the spherical toner, a contact-type charger, an image holding member, developing conditions, transferring conditions, and the like. These elements can be controlled to obtain a desired value. Such elements are not particularly limited, but the number of remaining toner particles can be controlled in view of the following elements.

(1) As toner cleaning properties of the surface of an image holding member with a fur brush, etc. are raised: brush material, resistance of a brush, brush external diameter, brush density, brush pile length, denier (thickness), brush tip force, nip width between the fur brush and an image holding member, an amount of a bite with an image holding member, load, applied voltage (direct current, alternating current), and the like.

(2) As a transferring performance of a transfer material are raised: resistance, hardness, nip width, load, applied voltage, introducing angle of paper, the charging amount of a toner on an image holding member, and the like.

(3) As the charging performance and the developing performance of a developer are raised: the charging amount of a toner particle, the charging amount of a carrier particle, resistance of a carrier particle, resistance of a developer, toner concentration, a developing roll (magnetic force, developing surface roughness, material, external diameter, speed, amount of developer, resistance, distance between a developing roll and an image holding member), and the like.

(4) Having the surface hardness of a charging roll used as a contact-type charger 70 or less as measured with a MD1 hardness meter.

(5) As others, material, resistance, nip width, load, applied voltage, and the like of a contact-type charger.

Moreover, the image forming apparatus of the invention controls an amount of deformation of a remaining toner small, effectively prevents the occurrence of toner filming, and obtain a stable image without defects over a long period by the following means. In the present invention, a remaining toner shape change rate (Tt) of remaining toner particles on a surface of an image holding member before passing through an abutting portion between an image holding member and a contact-type charging means is controlled in a range of 50% to 100%. The toner shape change rate (Tt) is preferably in a range of 65% to 100%, and more preferably in a range of 80% to 100%. The remaining toner shape change rate (Tt) is represented by the following equation (1):

$$Tt(\%)=(h/x)\times 100 \qquad \text{Equation (1)}$$

[In the equation (1), x represents a maximum length ($\mu$m) of a remaining toner particle projected image, h represents a maximum length ($\mu$m) of a remaining toner particle projected image formed on a plane perpendicular to an axis of the remaining toner particle projected image in a direction of the maximum length thereof, and $x \geqq h$]

Here, the "remaining toner shape change rate (Tt)" is obtained by sampling at least 0 to 50 remaining toner particles at a position before passing through an abutting portion between an image holding member and a contact-type charger or between an image holding member and a transfer member, inserting a maximum length x ($\mu$m) of an individual toner particle projected image and a maximum length h ($\mu$m) of a toner particle projected image formed on a plane perpendicular to an axis of the toner particle projected image in a direction of the maximum length thereof into the aforementioned equation (1), and averaging the resulting values.

The values x and h of sampled individual remaining toner particles are measured using an image analyzing apparatus (NEXUS: manufactured by NEXUS Co., Ltd.).

In the definition of the values x and h, "toner particle projected image" means a projected image of a toner particle (i.e. a spherical toner particle, a deformed toner particle, or the like) that appears on the surface of a planar screen when the toner particle is disposed between the planar screen and a light source that irradiates the screen with the light substantially perpendicular to the screen.

As such a toner shape change rate (Tt) of a remaining toner, a desired value can be obtained by controlling various elements such as a developer, a contact-type charger, an image holding member, developing conditions, transferring conditions and the like utilizing a spherical toner. Such elements are not particularly limited, but the toner shape change rate (Tt) is controlled in view of the following elements.

(1) Appropriately selecting the hardness of a spherical toner.

(2) A surface hardness of a charging roll used as a contact-type charging means is made to be 70 or smaller when measured by a MD1 hardness meter. The hardness is not necessarily correlated with a toner shape change rate.

The image forming apparatus of the invention comprises an image holding member, a contact-type charging means for contacting with a surface of this image holding member to charge the surface, an exposure means for forming an electrostatic latent image by exposing the surface of the image holding member charged by this contact-type charging means with the light depending on an image information, a developing means for developing this electrostatic latent image with the spherical toner to obtain a toner image, and a transferring means for electrostatically transferring this toner image from the surface of the image holding member onto a transfer material, and other means if necessary. In particular, when an image forming apparatus using a blade cleanerless system is applied as the image forming apparatus of the invention, the number of remaining toners is in a range of 200 to 300 and a toner shape change rate is 80% or more. Therefore, such effects can be exerted more effectively that toner pollution of the surface of a contact-type charging means can be prevented to maintain the well charged state for a long time, and toner filming on the surface of an image holding member can be prevented to perform stable image formation.

In the image forming method of the invention, a spherical toner is applied. Here, "spherical toner" means both of a toner having a shape of a complete true sphere and a toner having a shape near a true sphere. The spherical toner is usually prepared by a wet process such as a polymerization method and a dissolution method and the like. However, a process for preparing such a toner is not particularly limited as far as a substantially spherical toner is obtained. For example, the toner may be prepared by other process such as a mechanical grinding method and the like.

Such a spherical toner is quantitatively expressed by a shape factor (SF) represented by the following equation (2). The value of 100 means a true sphere, and a value nearer 100 means that the shape is nearer a true sphere. In the invention, this shape factor (SF) is preferably 135 or less, and more preferably 125 or less.

$$SF=(2\pi L^2/4A)\times 100 \qquad \text{Equation (2)}$$

[In the equation (2), L represents a maximum length ($\mu$m) of a spherical toner particle projected image, and A represents an area ($\mu m^2$) of the spherical toner particle projected image.]

When this shape factor (SF) exceeds 135, a contact area between a spherical toner and the surface of an image holding member becomes larger, and thus an adhering force of this spherical toner to the surface of the image holding member becomes larger, resulting in reduced transferring efficiency in some cases. Therefore, in such a case, toners which are wasted without being utilized for image formation are increased, being not preferable economically and ecologically.

The shape factor (SF) is obtained by measuring a maximum length L ($\mu$m) of a projected image of each of 100 spherical toner particles obtained by a polymerization method or the like and an area A ($\mu m^2$) of the spherical toner particle projected image using the aforementioned image analyzing apparatus (NEXUS: manufactured by NEXUS Co., Ltd.), inserting these values in the aforementioned equation (2), and averaging the resulting values.

In addition, a volume average particle diameter of a spherical toner is preferably in a range of 2 $\mu$m to 9 $\mu$m, and more preferably in a range of 5 $\mu$m to 8 $\mu$m.

When a volume average particle diameter is smaller than 2 $\mu$m, spherical toners become easy to fly from a developing unit, and pollution occurs in an image forming apparatus. In the case of a two-component developer, since the toners become easy to adhere to a carrier, the chargeability of the toner is reduced in some cases. On the other hand, when the volume average particle diameter exceeds 9 $\mu$m, there arises such an inconvenience that the image quality is reduced.

The "transfer material" used in the image forming apparatus of the invention means either an intermediate transfer member, which transfers a toner image on a surface of an image holding member to a recording material such as a recording paper and an OHP sheet, or a recording material, to which a toner image is directly transferred.

One example of an embodiment of the image forming apparatus of the invention will be explained by referring to the drawings, but the invention is not limited by the example shown by the drawings.

FIG. 1 is a schematic view showing one example of the image forming apparatus of the invention. An image forming apparatus 8 shown in FIG. 1 is a full color image forming apparatus employing a blade cleanerless electrophotographic method and a laser beam scanning exposing method. This full color image forming apparatus includes four image holding members 1*y*, 1*m*, 1*c* and 1*k*, four contact-type chargers (charging rolls) 2*y*, 2*m*, 2*c* and 2*k*, four developing units 3*y*, 3*m*, 3*c* and 3*k*, two primary transferring rolls 4*ym* and 4*ck*, a secondary transferring roll 5, a press roll 6, and brushes 15*y*, 15*m*, 15*c* and 15*k* provided on the surface of each image holding member, and has individual image holding members 1*y*, 1*m*, 1*c* and 1*k* for forming a toner image of four colors of Y (yellow), M (magenta), C (cyan) and K (black). A brush can also be provided on the surface of the primary transferring rolls, for example as shown by the brush 15*ym* of FIG. 1. As image holding members for these four colors, a negatively polar charging organic photosensitive material is used.

In addition, arrows Ly, Lm, Lc and Lk shown in FIG. 1 mean that laser beams are emitted from light sources (not shown) in directions of these arrows. Small letter alphabets of respective symbols, that is, y, m, c and k represent colors in which individual members constituting the image forming apparatus 8 participate in a process of forming a color image on the surface of a recording material 7, and y means yellow, m means magenta, c means cyan and k means black.

Around individual image holding members 1*y*, 1*m*, 1*c* and 1*k*, there are successively arranged contact-type chargers 2*y*, 2*m*, 2*c* and 2*k*, developing units 3*y*, 3*m*, 3*c* and 3*k*, and primary transferring rolls 4*ym* and 4*ck* along a rotation direction of carriers (arrow directions shown in individual image holding members 1*y*, 1*m*, 1*c* and 1*k* in FIG. 1). Respective image holding members, contact-type chargers and developing units make a pair every color. For example, in the case of yellow, the contact-type charger 2*y* and the developing unit 3*y* are disposed around the image holding member 1*y*. In addition, the surface of the rotating image holding member 1*y* is irradiated with a laser beam Ly for forming an image information of yellow as an electrostatic latent image after the surface is contacted with the contact-type charger 2*y* and until the surface faces the developing unit 3*y* in the vicinity. This is also true in the case of other three colors.

The primary transferring roll 4*ym* is arranged in contact with rotating image holding members 1*y* and 1*m* so as to rotate therewith, and the primary transferring roll 4*ck* is arranged in contact with rotating image holding members 1*c* and 1*k* so as to rotate therewith. In addition, the secondary transferring roll 5 is arranged in contact with primary rotating rolls 4*ym* and 4*ck* so as to rotate therewith. Further, the secondary transferring roll 5 is abutted against the press roll 6 and, when the recording material 7 passes through this abutting part, an image is formed on the surface of the recording material 7 on a secondary transferring roll 5 side.

Respective image holding members 1*y*, 1*m*, 1*c* and 1*k* are uniformly charged with respective contact-type chargers 2*y*, 2*m*, 2*c* and 2*k* and, thereafter, electrostatic latent images are formed on the surfaces thereof with modified laser beams Ly, Lm, Lc and Lk. Electrostatic latent images on the surfaces of image holding members 1*y*, 1*m*, 1*c* and 1*k* are developed into toner images with developing units 3*y*, 3*m*, 3*c* and 3*k*. Two colors of yellow and magenta of developed toner images are transferred onto the primary transferring roll 4*ym*, and two colors of cyan and black are transferred onto the primary transferring roll 4*ck*. Toner images transferred by primary transferring rolls 4*ym* and 4*ck* are transferred onto the secondary transferring roll 5. The color toner images transferred by the secondary transferring roll 5 are transferred collectively onto the surface of the recording material 7 when the material passes through an abutting portion between the secondary transferring roll 5 and the press roll 6. A positively polar bias is applied to primary transferring rolls 4*ym* and 4*ck*, and the secondary transferring roll 5 and the press roll 6 with an electric source (not shown), and a negatively-polar toner can be electrostatically transferred thereon.

And, toners remaining on a carrier after toner transference are trapped once with brushes 15*y*, 15*m*, 15*c* and 15*k* without blade cleaning, and stored to an extent and, thereafter, the remaining toners are discharged.

In the image forming apparatus 8 having the aforementioned essential features, when the contact-type chargers 2*y*, 2*m*, 2*c* and 2*k* are composed of an electrically conducting or semiconducting roller (hereinafter, abbreviated as "charging roll"), a direct current is usually applied to image holding members 1*y*, 1*m*, 1*c* and 1*k*, and an alternating current may be further applied superimposedly.

Image holding members 1*y*, 1*m*, 1*c* and 1*k* are usually charged at −300 to −1000 V with the aforementioned charging means. In addition, when contact-type chargers 2*y*, 2*m*, 2*c* and 2*k* are composed of a charging roll, in the invention, at least one or more intermediate layers are formed on the surface of a rotator, and a superficial layer composed of at least an elastic element is further formed on the surface. However, such a feature may be adopted that only a superficial layer composed of at least an elastic element is formed on the surface of a rotator.

In contact-type chargers 2*y*, 2*m*, 2*c* and 2*k*, for example, an intermediate layer composed of at least one or more layers is formed on the surface of a rotator such as a shaft or the like composed of a rigid material such as a metal or the like, and a superficial layer composed of an elastic element is further formed on the surface.

An elastic element forming a superficial layer is semiconducting, and examples of a binder material for this elastic element include rubber materials such as SBR (styrene butadiene rubber), BR (polybutadiene rubber), Hi styrene resin masterbatch, IR (isoprene rubber), IIR (butyl rubber), halogenated butyl rubber, NBR (nitrile butadiene rubber), hydrogenated NBR (H-NBR), EPDM (ethylene-propylene-diene tercopolymer rubber), EPM (ethylene propylene rubber), rubber obtained by blending NBR and EPDM, CR (chloroprene rubber), ACM (acrylic rubber), CO (hydrin rubber), ECO (epichlorohydrin rubber), chlorinated polyethylene (chlorinated-PE), VAMAC (ethylene/acrylic rubber), VMQ (silicone rubber), AU (urethane rubber), FKM (fluorine rubber), NR (natural rubber), CSM (chlorosulfonated polyethylene rubber) and the like. Binder materials other than exemplified ones may be used as far as they are rubber materials, being not particularly limiting.

An intermediate layer is electrically conducting or semiconducting, and examples of an binder material constituting the intermediate layer include rubber materials such as SBR (styrene butadiene rubber), BR (polybutadiene rubber), Hi styrene resin masterbatch, IR (isoprene rubber), IIR (butyl rubber), halogenated butyl rubber, NBR (nitrile butadiene rubber), hydrogenated NBR (H-NBR), EPDM (ethylene-propylene-diene tercopolymer rubber), EPM (ethylene propylene rubber), rubber obtained by blending NBR and EPDM, CR (chloroprene rubber), ACM (acrylic rubber), CO (hydrin rubber), ECO (epichlorohydrin rubber), chlorinated polyethylene (chlorinated-PE), VAMAC (ethylene/acrylic rubber), VMQ (silicone rubber), AU (urethane rubber), FKM (fluorine rubber), NR (natural rubber), CSM (chlorosulfonated polyethylene rubber) and the like.

In addition to the aforementioned rubber materials, examples further include resin materials such as PVC, polyethylene, polypropylene, polystyrene, polyester, polyurethane, polyamide, polyimide, nylon, ethylene vinyl acetate, ethylene ethyl acrylate, ethylene methyl acrylate, styrene butadiene, polyacrylate, polycarbonate, Teflon (R) and silicone and, additionally, homopolymers of styrene or substituted styrene such as polystyrene, polyvinyltoluene and the like; styrene type copolymers such as styrene-propylene copolymer, styrene-vinyltoluene copolymer, styrene vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacryalate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, styrene-maleic acid ester copolymer and the like, respective resins such as polymethacrylate, polybutyl methacrylate, polyvinyl acetate, polyethylene, polypropylene, polyvinyl butyral, polyacrylic acid resin, rosin, modified rosin, terpene resin, phenol resin, aliphatic or alicyclic hydrocarbon resin, aromatic petroleum resin, paraffin wax, carnauba wax and the like, and mixture thereof. Materials other than above exemplified ones may be used as far as they are rubber materials, resin materials, copolymer materials or mixtures thereof, being not particularly limiting.

Image holding members 1*y*, 1*m*, 1*c* and 1*k* are not limited as far as they have at least the function of forming a latent image, but electrophotographic photosensitive materials are preferably used. The electrophotographic photosensitive materials may be a mono-layered type electrophotographic photosensitive material composed of a deposition membrane of a charge generating substance and, in the invention, a function-separated type laminated electrophotographic photosensitive material can be preferably used.

In the image forming apparatus 8 shown in FIG. 1, a laser beam is used as an exposing means, being not limiting. Examples of the exposing means include optical equipment which can expose the surfaces of image holding members 1*y*, 1*m*, 1*c* and 1*k* with light-sources such as the semiconductor laser light, the LED light, the liquid crystal shutter light and the like into a desired image.

Developing units 3*y*, 3*m*, 3*c* and 3*k* are not particularly limited as far as they have the function of developing an electrostatic latent image formed on surfaces of image-carries 1*y*, 1*m*, 1*c* and 1*k* with a spherical toner to form a toner image, but examples thereof include the known developing units having the function of adhering a spherical toner to image holding members 1*y*, 1*m*, 1*c* and 1*k* using a brush, a roller or the like.

Brushes 15*y*, 15*m*, 15*c* and 15*k* are not particularly limited, and they may be electrically conducting, semiconducting or insulating. During image formation, an alternating current bias or a direct current bias is applied, and during a cleaning sequence, a reverse bias is applied or bias is turned off. Conditions for brushes and image holding members include a nip width, a bite, a load, a difference in speeds, a rotation direction and the like.

As a transference current which is imparted from image holding members 1*y*, 1*m*, 1*c* and 1*k* to primary transferring rolls 4*ym* and 4*ck*, and from primary transferring rolls 4*ym* and 4*ck* to a secondary transferring roll 5, a direct current is usually used, but in the invention, an alternating current may be further used superimposedly. Conditions for primary transferring rolls 4*ym* and 4*ck* and a secondary transferring roll 5 may be arbitrarily set by a width of an image region to be charged, a shape of a transferring charger, an opening width, a process speed (circumferential speed) and the like.

As a transference current which is imparted from the press roll 6 to the recording material 7, a direct current is usually used, but in the invention, an alternating current may be further used superimposedly. Conditions for the press roll 6 may be arbitrarily set by a width of an image region to be charged, a shape of a transferring charger, an opening width, a process speed (circumferential speed) and the like.

In addition, for the purpose of exchanging expendable parts of the image forming apparatus at an appropriate time, the invention can be also applied to a process cartridge which is attachable to or detachable from the image forming apparatus by incorporating some of constituent parts of the image forming apparatus so that exchange work can be easily performed. This process cartridge is dealt with in the state where mounted in the image forming apparatus, and is dealt with by itself as an exchanging part or a repairing part.

EXAMPLES

Examples of the present invention will be explained below, but the invention is not limited by these Examples.

In the following Examples, image formation was performed using an image forming apparatus using a blade cleanerless system having the same construction as that of the image forming apparatus 8 shown in FIG. 1. As developers for four colors of Y (yellow), M (magenta), C (cyan), K (black), negatively-polar chargeable two-component developers employing a substantially spherical polymerized wet toner having a volume average particle diameter of 6 to 7 $\mu$m and a shape factor (SF) of 110 were used.

Example 1

An image forming apparatus 8 of Example 1 employed a two-component developer and 3 denier fur brushes as brushes 15*y*, 15*m*, 15*c* and 15*k* on the surfaces of image holding members 1*y*, 1*m*, 1*c* and 1*k*. In the two-component developer, a toner concentration based on a carrier was 11% and a charging amount of the toner to a carrier was −35 $\mu$C/g. The 3 denier fur brushes were made of nylon fibers with carbon dispersed therein, having a density of 230 kF/inch$^2$.

In this image forming apparatus 8 of Example 1, the number of remaining toner particles was 136 and a remaining toner shape change rate (Tt) was 70%.

Then, by the image forming apparatus 8 of Example 1, with respect to full color images of three patterns such as a letter, a half tone, a color skew, running tests were performed 30,000 times using an A4 size P paper (manufactured by Fuji Xerox Co., Ltd.) as the recording material 7, and occurrence of pollution of a contact-type charger and occurrence of toner filming were evaluated. The results are shown in Table 1.

Example 2

An image forming apparatus 8 of Example 2 employed a two-component developer and 2 denier fur brushes as brushes 15*y*, 15*m*, 15*c* and 15*k* on the surfaces of image holding members 1*y*, 1*m*, 1*c* and 1*k*. In the two-component developer, a toner concentration based on a carrier was 11% and a charging amount of the toner to a carrier was −35 $\mu$C/g. The 2 denier fur brushes were made of acrylic fibers with carbon dispersed therein, having a density of 100 kF/inch$^2$.

In this image forming apparatus of Example 2, the number of remaining toner particles was 218 and a remaining toner shape change rate (Tt) was 80%.

Then, the same test as that of Example 1 was performed by the image forming apparatus 8 of Example 2. The results are shown in Table 1.

Example 3

An image forming apparatus 8 of Example 3 employed the same members as those of Example 1 except in that in a two-component developer, the toner concentration based on a carrier was 10% and a charging amount of the toner to a carrier was −40 $\mu$C/g.

In this image forming apparatus of Example 3, the number of remaining toner particles was 270 and a remaining toner shape change rate (Tt) was 95%.

Then, the same test as that of Example 1 was performed by the image forming apparatus 8 of Example 3. The results are shown in Table 1.

Example 4

An image forming apparatus 8 of Example 4 employed a two-component developer and 2 denier fur brushes as brushes 15*y*, 15*m*, 15*c* and 15*k* on the surfaces of image holding members 1*y*, 1*m*, 1*c* and 1*k*. In the two-component developer, a toner concentration based on a carrier was 10% and a charging amount of the toner to a carrier was −40 $\mu$C/g. The 2 denier fur brushes were made of acrylic fibers with carbon dispersed therein, having a density of 100 kF/inch$^2$.

In this image forming apparatus of Example 4, the number of remaining toner particles was 110 and a remaining toner shape change rate (Tt) was 60%.

Then, the same test as that of Example 1 was performed by the image forming apparatus 8 of Example 4. The results are shown in Table 1.

Example 5

An image forming apparatus 8 of Example 5 employed the same members as those of Example 1 except in that in a two-component developer a toner concentration to a carrier was 7% and a charging amount of the toner to a carrier was −50 $\mu$C/g, and the weight of a carrier and a toner on the developing sleeve surface of developing units 3*y*, 3*m*, 3*c* and 3*k* was 300 g/m$^2$.

In this image forming apparatus of Example 5, the number of remaining toner particles was 163 and a remaining toner shape change rate (Tt) was 65%.

Then, the same test as that of Example 1 was performed by the image forming apparatus 8 of Example 5. The results are shown in Table 1.

Example 6

An image forming apparatus 8 of Example 6 employed a two-component developer and 2 denier fur brushes as brushes 15*y*, 15*m*, 15*c* and 15*k* on the surfaces of image holding members 1*y*, 1*m*, 1*c* and 1*k*. In the two-component developer, a toner concentration based on a carrier was 11% and a charging amount of the toner to a carrier was −30 $\mu$C/g. The 2 denier fur brushes were made of acrylic fibers with carbon dispersed therein, having a density of 100 kF/inch$^2$.

In this image forming apparatus of Example 3, the number of remaining toner particles was 380 and a remaining toner shape change rate was 97%.

Then, the same test as that of Example 1 was performed by the image forming apparatus 8 of Example 6. The results are shown in Table 1.

Comparative Example 1

An image forming apparatus 8 of Comparative Example 1 employed the same members as those of Example 1 except in that in a two-component developer the toner concentration based on a carrier was 12% and a charging amount of the toner to a carrier was −30 $\mu$C/g.

In this image forming apparatus 8 of Comparative Example 1, the number of remaining toner particles was 544 and a remaining toner shape change rate was 95%.

Then, the same test as that of Example 1 was performed by the image forming apparatus 8 of Comparative Example 1. The results are shown in Table 1.

Comparative Example 2

An image forming apparatus 8 of Comparative Example 2 employed the same members as those of Example 1 except in that in a two-component developer the toner concentration based on a carrier was 5% and a charging amount of the toner to a carrier was −55 μC/g.

In this image forming apparatus of Comparative Example 2, the number of remaining toner particles was 55 and a remaining toner shape change rate was 25%.

Then, the same test as that of Example 1 was performed by the image forming apparatus 8 of Comparative Example 2. The results are shown in Table 1.

Comparative Example 3

An image forming apparatus 8 of Comparative Example 3 employed a two-component developer and 2 denier fur brushes as brushes 15*y*, 15*m*, 15*c* and 15*k* on the surfaces of image holding members 1*y*, 1*m*, 1*c* and 1*k*. In the two-component developer, a toner concentration based on a carrier was 12% and a charging amount of this toner to a carrier was −30 μC/g. The 2 denier fur brushes were made of acrylic fibers with carbon dispersed therein, having a density of 100 kF/inch$^2$.

In this image forming apparatus of Comparative Example 3, the number of remaining toner particles was 408 and a remaining toner shape change rate was 90%.

Then, the same test as that of Example 1 was performed by the image forming apparatus 8 of Comparative Example 3. The results are shown in Table 1.

Comparative Example 4

An image forming apparatus 8 of Comparative Example 4 employed the same members as those of Example 1 except in that in a two-component developer the toner concentration based on a carrier was 12% and a charging amount of the toner to a carrier was −30 μC/g, and the distance between the developing sleeve surfaces of developing units 3*y*, 3*m*, 3*c* and 3*k* and the surfaces of image holding members 1*y*, 1*m*, 1*c* and 1*k* was 0.45 mm.

In this image forming apparatus of Comparative Example 4, the number of the remaining toner particles was 800 and a remaining toner shape change rate was 98%.

Then, the same test as that of Example 1 was performed by the image forming apparatus 8 of Comparative Example 4. The results are shown in Table 1.

Comparative Example 5

An image forming apparatus 8 of Comparative Example 5 employed a two-component developer and 2 denier fur brushes as brushes 15*y*, 11*m*, 15*c* and 15*k* on the surfaces of image holding members 1*y*, 1*m*, 1*c* and 1*k*. In the two-component developer a toner concentration based on a carrier was 5% and a charging amount of the toner to a carrier was −55 μC/g. The 2 denier fur brushes were made of acrylic fibers with carbon dispersed therein, having a density of 100 kF/inch$^2$.

In this image forming apparatus of Comparative Example 5, the number of remaining toners was 30 and a remaining toner shape change rate (Tt) was 10%.

Then, the same test as that of Example 1 was performed by the image forming apparatus 8 of Comparative Example 5. The results are shown in Table 1.

(Evaluation of Pollution of Contact-Type Charger and Toner Filming)

Image defects due to pollution of a contact-type charger and toner filming in a running test were evaluated with naked eyes.

○: In 30,000 full color images, images were not defective and were good.

X: In 30,000 full color images, image defects occurred.

Image defects due to pollution of a contact-type charger were evaluated by observing, with naked eyes, white spots at half tone imaging or image defects deriving from toner flying from a contact-type charger. Image defects due to toner filming were evaluated by observing white spots at half tone imaging with naked eyes.

TABLE 1

| | Number of remaining toners (n) | Shape change rate of remaining toner (%) | pollution of charger | Filming |
|---|---|---|---|---|
| Example 1 | 136 | 70 | ○ | ○ |
| Example 2 | 218 | 80 | ○ | ○ |
| Example 3 | 270 | 95 | ○ | ○ |
| Example 4 | 110 | 60 | ○ | ○ |
| Example 5 | 163 | 65 | ○ | ○ |
| Example 6 | 380 | 97 | ○ | ○ |
| Comparative Example 1 | 544 | 95 | X | ○ |
| Comparative Example 2 | 55 | 25 | ○ | X |
| Comparative Example 3 | 408 | 90 | X | ○ |
| Comparative Example 4 | 800 | 98 | ○ | X |
| Comparative Example 5 | 30 | 10 | X | ○ |

From the results of Table 1, it is seen that the number of remaining toners is controlled within a range of 100 to 400 and, in the image forming apparatus, pollution of a charger and toner filming can be suppressed for a long time. Additionally, as learned from the results, when the number of remaining toners is controlled within a range of 100 to 400, it is easy to obtain a remaining toner shape change rate of 50% or more and, thus, the aforementioned effects are exerted more effectively.

As described above, the present invention provides an image forming apparatus which can perform stable image formation by using a spherical toner, preventing toner pollution of the surface of a contact-type charging means, maintaining a well charged state for a long time, and preventing toner filming on the surface of an image holding member. The present invention also provides a process cartridge that is attachable to and detachable from the image forming apparatus.

What is claimed is:

1. An image forming apparatus comprising:

an image holding member;

a contact-type charger for charging a surface of the image holding member;

an exposure unit for forming an electrostatic latent image by exposing the charged surface of the image holding member;

a developing unit for developing the electrostatic latent image with a spherical toner to obtain a toner image; and a transfer member for electrostatically transferring the toner image from the surface of the image holding member onto a transfer material, wherein a number of toner particles remaining on the surface of the image holding member before passing through an abutting portion between the image holding member and the contact-type charger is in a range of 100 to 400 per $mm^2$.

2. The image forming apparatus of claim 1, wherein the number of toner particles remaining on the surface of the image holding member before passing through the abutting portion between the image holding member and the contact-type charger is in a range of 150 to 350 per $mm^2$.

3. The image forming apparatus of claim 1, wherein the number of toner particles remaining on the surface of the image holding member before passing through the abutting portion between the image holding member and the contact-type charger is in a range of 200 to 300 per $mm^2$.

4. The image forming apparatus of claim 1, wherein a toner shape change rate (Tt) of toner particles remaining on the surface of the image holding member before passing through the abutting portion between the image holding member and the contact-type charger is in a range of 50% to 100%, the toner shape change rate (Tt) being represented by the following equation (1), $$Tt(\%)=(h/x)\times 100 \qquad \text{Equation (1)}$$

wherein x represents a maximum length ($\mu$m) of a remaining toner particle projected image, h represents a maximum length ($\mu$m) of a remaining toner particle projected image formed on a plane perpendicular to an axis of the remaining toner particle projected image in a direction of the maximum length of the remaining toner particle projected image, and $x \geqq h$.

5. The image forming apparatus of claim 4, wherein the toner shape change rate (Tt) is in a range of 65% to 100%.

6. The image forming apparatus of claim 4, wherein the toner shape change rate (Tt) is in a range of 80% to 100%.

7. The image forming apparatus of claim 1, wherein a shape factor (SF) of the spherical toner is 135 or less, the shape factor (SF) being represented by the following equation (2)

$$SF=(2\pi L^2/4A)\times 100 \qquad \text{Equation (2)}$$

wherein L represents a maximum length ($\mu$m) of a spherical toner particle projected image, and A represents an area ($\mu m^2$) of the spherical toner particle projected image.

8. The image forming apparatus of claim 7, wherein the shape factor (SF) is 125 or less.

9. The image forming apparatus of claim 1, wherein a volume average particle diameter of the spherical toner is in a range of 2 $\mu$m to 9 $\mu$m.

10. The image forming apparatus of claim 9, wherein the volume average particle diameter is in a range of 5 $\mu$m to 8 $\mu$m.

11. A process cartridge comprising at least an image holding member and a contact-type charger for charging a surface of the image holding member, wherein a number of toner particles remaining on the surface of the image holding member before passing through an abutting portion between the image holding member and the contact-type charger is in a range of 100 to 400 per $mm^2$.

12. The process cartridge of claim 11, wherein a toner shape changing rate (Tt) of toner particles remaining on the surface of the image holding member before passing through the abutting portion between the image holding member and the contact-type charger is in a range of 50% to 100%, the toner shape changing rate (Tt) being represented by the following equation (1), $$Tt(\%)=(h/x)\times 100 \qquad \text{Equation (1)}$$

wherein x represents a maximum length ($\mu$m) of a remaining toner particle projected image, h represents a maximum length ($\mu$m) of a remaining toner particle projected image formed on a plane perpendicular to an axis of the remaining toner particle projected image in a direction of the maximum length of the remaining toner particle projected image, and $x \geqq h$.

13. An image forming method comprising the steps of:

charging a surface of an image holding member;

forming an electrostatic latent image by exposing the charged surface of the image holding member;

developing the electrostatic latent image with a spherical toner to obtain a toner image; and electrostatically transferring the toner image from the surface of the image holding member onto a transfer material, wherein a number of toner particles remaining on the surface of the image holding member before passing through an abutting portion between the image holding member and a contact-type charger is in a range of 100 to 400 per $mm^2$.

14. The image forming method of claim 13, wherein a toner shape change rate (Tt) of toner particles remaining on the surface of the image holding member before passing through the abutting portion between the image holding member and the contact-type charger is in a range of 50% to 100%, the toner shape change rate (Tt) being represented by the following equation (1), $$Tt(\%)=(h/x)\times 100 \qquad \text{Equation (1)}$$

wherein x represents a maximum length ($\mu$m) of a remaining toner particle projected image, h represents a maximum length ($\mu$m) of a remaining toner particle projected image formed on a plane perpendicular to an axis of the remaining toner particle projected image in a direction of the maximum length of the remaining toner particle projected image, and $x \geqq h$.

15. The image forming method of claim 13, wherein a shape factor (SF) of the spherical toner is 135 or less, the shape factor (SF) being represented by the following equation (2)

$$SF=(2\pi L^2/4A)\times 100 \qquad \text{Equation (2)}$$

wherein L represents a maximum length ($\mu$m) of a spherical toner particle projected image, and A represents an area ($\mu m^2$) of the spherical toner particle projected image.

16. The image forming method of claim 13, wherein a volume average particle diameter of the spherical toner is in a range of 2 $\mu$m to 9 $\mu$m.

* * * * *